US007591036B2

(12) United States Patent
Lin et al.

(10) Patent No.: US 7,591,036 B2
(45) Date of Patent: Sep. 22, 2009

(54) AIR-INFLATED MATTRESS

(75) Inventors: Hua Hsiang Lin, Xiamen (CN); Yaw Yuan Hsu, Xiamen (CN); Lan Lee, Xiamen (CN)

(73) Assignee: Intex Recreation Corp., Long Beach, CA (US)

( * ) Notice: Subject to any disclaimer, the term of this patent is extended or adjusted under 35 U.S.C. 154(b) by 0 days.

(21) Appl. No.: 12/056,578

(22) Filed: Mar. 27, 2008

(65) Prior Publication Data

US 2008/0209643 A1 Sep. 4, 2008

Related U.S. Application Data

(62) Division of application No. 11/449,287, filed on Jun. 8, 2006, now Pat. No. 7,406,735.

(51) Int. Cl.
*A47C 27/08* (2006.01)

(52) U.S. Cl. ..... 5/712; 5/711; 5/713

(58) Field of Classification Search ..... 5/712, 5/706, 710, 711, 713, 654, 655.3, 644
See application file for complete search history.

(56) References Cited

U.S. PATENT DOCUMENTS

| | | | | | |
|---|---|---|---|---|---|
| 2,318,492 | A * | 5/1943 | Johnson | 5/712 |
| 2,604,641 | A * | 7/1952 | Reed | 5/710 |
| 2,703,770 | A * | 3/1955 | Melzer | 5/710 |
| 4,225,989 | A * | 10/1980 | Corbett et al. | 5/713 |
| 5,044,030 | A * | 9/1991 | Balaton | 5/710 |
| 5,561,873 | A * | 10/1996 | Weedling | 5/713 |
| 5,598,593 | A * | 2/1997 | Wolfe | 5/710 |
| 5,638,565 | A * | 6/1997 | Pekar | 5/710 |
| 5,729,840 | A * | 3/1998 | Wu | 4/588 |
| 5,740,573 | A * | 4/1998 | Boyd | 5/711 |
| 5,890,245 | A * | 4/1999 | Klearman et al. | 5/714 |
| 5,906,019 | A * | 5/1999 | McCarthy et al. | 5/710 |
| 6,073,291 | A * | 6/2000 | Davis | 5/711 |
| 6,332,760 | B1 * | 12/2001 | Chung | 417/411 |
| 6,546,580 | B2 * | 4/2003 | Shimada | 5/710 |
| 6,568,011 | B2 * | 5/2003 | Fisher et al. | 5/706 |
| 6,671,910 | B2 * | 1/2004 | Hsu et al. | 5/710 |
| 6,701,559 | B2 * | 3/2004 | Boso et al. | 5/739 |

(Continued)

*Primary Examiner*—Robert G Santos
(74) *Attorney, Agent, or Firm*—Lewis Brisbois Bisgaard & Smith LLP; Sanford Astor

(57) ABSTRACT

A double air-inflated mattress having an upper chamber and a lower chamber, the upper chamber having a top layer, an outer shroud band, a plurality of anchor separators and a bottom layer, the outer shroud band connecting the top and bottom layers to form an inflatable bladder; a middle layer below said top layer partially sealed to the top layer to form a plurality of sealed or half-sealed cavities, in which some or all of said cavities are in fluid communication with the inflatable bladder, the lower chamber having a top layer, an outer shroud band, a plurality of anchor separators and a bottom layer, said outer shroud band connecting the top and bottom layers to form an inflatable bladder. Each chamber of the double mattress may also have a middle shroud band and an inner shroud band, both of said middle shroud bands being separately welded to the outer shroud bands and the inner shroud bands to form a plurality of closed or half-closed cavities, some or all of said cavities being in fluid communication with its respective inflatable bladder to form a plurality of air pockets on the outer shroud bands of the double air mattress.

19 Claims, 14 Drawing Sheets

U.S. PATENT DOCUMENTS

| | | | | |
|---|---|---|---|---|
| 6,754,925 | B1 * | 6/2004 | Wang | 5/706 |
| 6,754,926 | B2 * | 6/2004 | Wang | 5/710 |
| 6,971,134 | B2 * | 12/2005 | Wu | 5/712 |
| 6,973,690 | B2 * | 12/2005 | Muci et al. | 5/644 |
| 6,996,867 | B2 * | 2/2006 | Boso et al. | 5/739 |
| 7,089,618 | B1 * | 8/2006 | Metzger | 5/709 |
| 7,107,641 | B2 * | 9/2006 | Davis | 5/710 |
| 7,165,283 | B2 * | 1/2007 | Boso et al. | 5/739 |
| 7,254,853 | B1 * | 8/2007 | Kim | 5/712 |
| 7,269,866 | B2 * | 9/2007 | Liu | 5/711 |
| 7,337,485 | B2 * | 3/2008 | Metzger | 5/712 |
| 7,367,073 | B2 * | 5/2008 | Boyd | 5/710 |
| 7,376,995 | B2 * | 5/2008 | Davis | 5/710 |
| 7,380,300 | B2 * | 6/2008 | Boyd | 5/706 |
| 7,406,735 | B2 * | 8/2008 | Lin et al. | 5/712 |
| 7,478,448 | B2 * | 1/2009 | Boso et al. | 5/739 |
| 7,530,128 | B2 * | 5/2009 | Wu | 5/712 |
| 2002/0050010 | A1 * | 5/2002 | Shimada | 5/706 |
| 2002/0083528 | A1 * | 7/2002 | Fisher et al. | 5/706 |
| 2003/0024050 | A1 * | 2/2003 | Boso et al. | 5/711 |
| 2003/0101516 | A1 * | 6/2003 | Hsu et al. | 5/710 |
| 2004/0010853 | A1 * | 1/2004 | Muci et al. | 5/644 |
| 2004/0194219 | A1 * | 10/2004 | Boso et al. | 5/711 |
| 2007/0044243 | A1 * | 3/2007 | Metzger | 5/712 |
| 2007/0283499 | A1 * | 12/2007 | Lin et al. | 5/712 |
| 2008/0209642 | A1 * | 9/2008 | Lin et al. | 5/711 |
| 2008/0209643 | A1 * | 9/2008 | Lin et al. | 5/711 |

* cited by examiner

AIR-INFLATED MATTRESS

This application is a divisional of U.S. patent application Ser. No. 11/449,287, filed Jun. 8, 2006, now U.S. Pat. No. 7,406,735.

FIELD OF THE INVENTION

The present invention relates to an air-inflated mattress, and more particularly to a supporting structure of an air mattress.

DESCRIPTION OF PRIOR ART

The inflatable mattress, by means of its light weight, easy storage and portable features, not only is used as an outdoor apparatus, but also is accepted as indoor furniture. The conventional prior art inflatable mattress, shown in FIGS. 1 & 2, is typically comprised of a top layer 1', a shroud band 2', a plurality of cylindrical anchor separators 3' and a bottom layer 4', The shroud band 2' connects the top and bottom layers 1' and 4' together to form an inflatable bladder. To keep the bladder level and even, a plurality of cylindrical anchor separators 3' are respectively connected on the top and bottom layers 1' and 4', vertically parallel to the shroud band 2', thereby keeping the inflated mattress as similar to a conventional mattress as possible.

But, there are shortcomings existing in the prior art inflatable mattress, as follows:

1. When the bladder is filled fully with air, the surface of the mattress will appear to be full of bumps and holes occurring due to the plurality of cylindrical anchor separators 3'. The joint portion of the cylindrical anchor separator 3' is somewhat concave, but the portion between adjacent anchor separators 3' is somewhat convex, so that the contact area with the body of the user is relatively reduced, which will make the user uncomfortable.
2. When the surface of the mattress is pressed down with extra force, the shroud band will be squeezed outwardly by the compressed air inside of the bladder, to form a crowned bump, further affecting the smoothness of the mattress.
3. As some part of the surface of the mattress is exerted with extra force, such as, if the edge of the mattress is pressed down by an extra force, shroud band 2' will not resist the force, and that portion of the mattress will collapse, losing stability.

Since the above-mentioned disadvantages exist, the conventional prior art inflatable mattress cannot compare with an innerspring mattress.

OBJECTS OF THE INVENTION

It is therefore an object of the present invention to provide an air-inflated mattress that has an improved top surface, which increases the contact area of the mattress with the human body, for increasing comfort in use.

It is a further object of the present invention to provide an air-inflated mattress that not only keeps the evenness of the surface of the mattress, but also enhances the support intensity of the edges.

SUMMARY OF THE INVENTION

To achieve the above-mentioned objects, the present invention provides an air-inflated mattress, which is comprised of a top layer, a shroud band, a plurality of anchor separators and a bottom layer. Said shroud band connects the top and bottom layers together, to form an inflatable bladder. A middle layer is built below the top layer, by sealing some portions on the inside of the top layer to form a plurality of cross-sealed or half-sealed cavities. Some or all of said cavities are in fluid communication with the inflatable bladder, so as to form a plurality of small air-pockets on the surface of the mattress.

Said small air-pockets are arrayed on portions of the surface of the air mattress in contact with the human body.

Some of said cavities communicate with the inflatable bladder via air vents built into the middle layer.

The joint lines welding the top and middle layers together, create closed or half-closed patterns to form air pockets.

Anchor separators in cylindrical, or other shapes, have air holes on the joint portions of the anchor separator's trunk, and are connected with said middle layer and bottom layer separately at opposite ends of the trunk.

In another embodiment, the inflatable mattress also includes a middle shroud band and an inner shroud band, wherein said middle shroud band separately connects, by welded joints, to the outer shroud band and the inner shroud band to form alternative anchor points, to divide into several closed or half-closed cavities. Some of said cavities are in fluid communication with said inflatable bladder to form a plurality of air pockets on the outer shroud band of the air mattress.

The middle and inner shroud bands have riser vents communicating with said inflatable bladder.

Said middle shroud band is fixed on the outer shroud band by line welding to form closed or half-closed air pockets.

The present invention has the following advantages:

1. improved evenness and outer look of the surface, due to adding a middle layer below the top layer, and fixing the anchor separators on the middle layer instead of fixing them on the top layer.
2. said middle layer is fixed alternatively with said anchor separators, so that when the bladder constructed by the top and bottom layers and the outer shroud band is fully inflated with air, the concave points of the middle layer, formed by tension of the anchor separators via the joint portion, are covered by the top layer, fixed on the convex points between the anchor separators and middle layer joint spots. The concave points and convex points are balanced as the space of the cavities surrounded by them is inflated fully with air, therefore the surface of the air mattress is flat and the evenness of the mattress is improved greatly.
3. more comfortable, due to several small air pockets formed between joint spots welding the top layer and the middle layer, and the communication of small air pockets in the inflatable bladder. When extra force is exerted on parts of the surface of the air mattress, the air in the small air pockets on the pressed portion of the air mattress will be baffled by the riser vents of the middle layer, escaping slowly without spreading out rapidly, so that the supporting effect of the air mattress is improved, and the air pockets work as air springs to increase the restoring force, so that the user will feel more comfortable.
4. enhanced edge support, based on the same principle, due to adding a middle shroud band and an inner shroud band at the inside of the outer shroud band to construct half-sealed sub-chambers. Meanwhile, the middle shroud band connects to the outer and inner shroud bands, alternatively and respectively, to surround the sub-chambers, so that the inflated sub-chambers not only work as reinforcing ribs, but also make the outer shroud band flat, improving the outer look. When the edge of the air mattress is exerted upon with extra force, due to the limitation of the riser vents, the air filled in the sub-chambers will not flow rapidly to the inside of the bladder, so that the supporting effect of the edge of the air mattress is efficiently improved without collapsing or tilting.

DETAILED DESCRIPTION OF PREFERRED EMBODIMENTS

Figure 1:
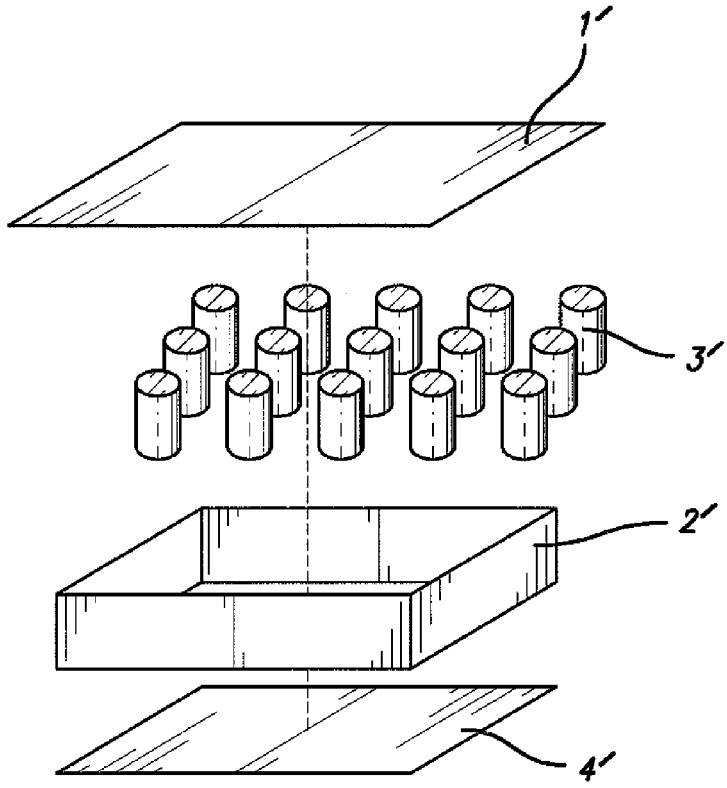
FIG. 1 PRIOR ART
FIG. 1 is an exploded view of the prior art.
Figure 2:
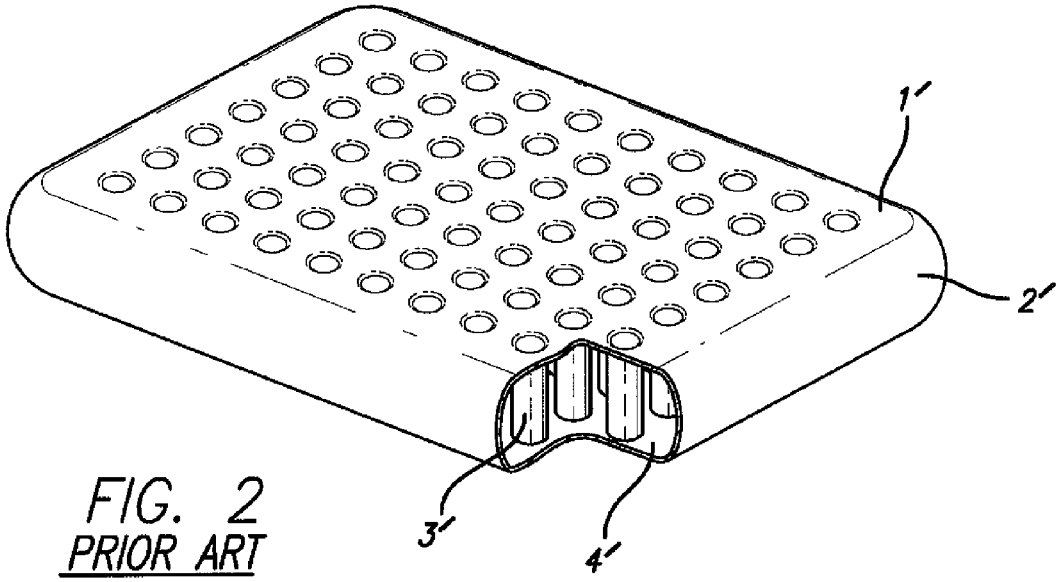
FIG. 2 PRIOR ART
FIG. 2 is a perspective view of the prior art.
Figure 3:
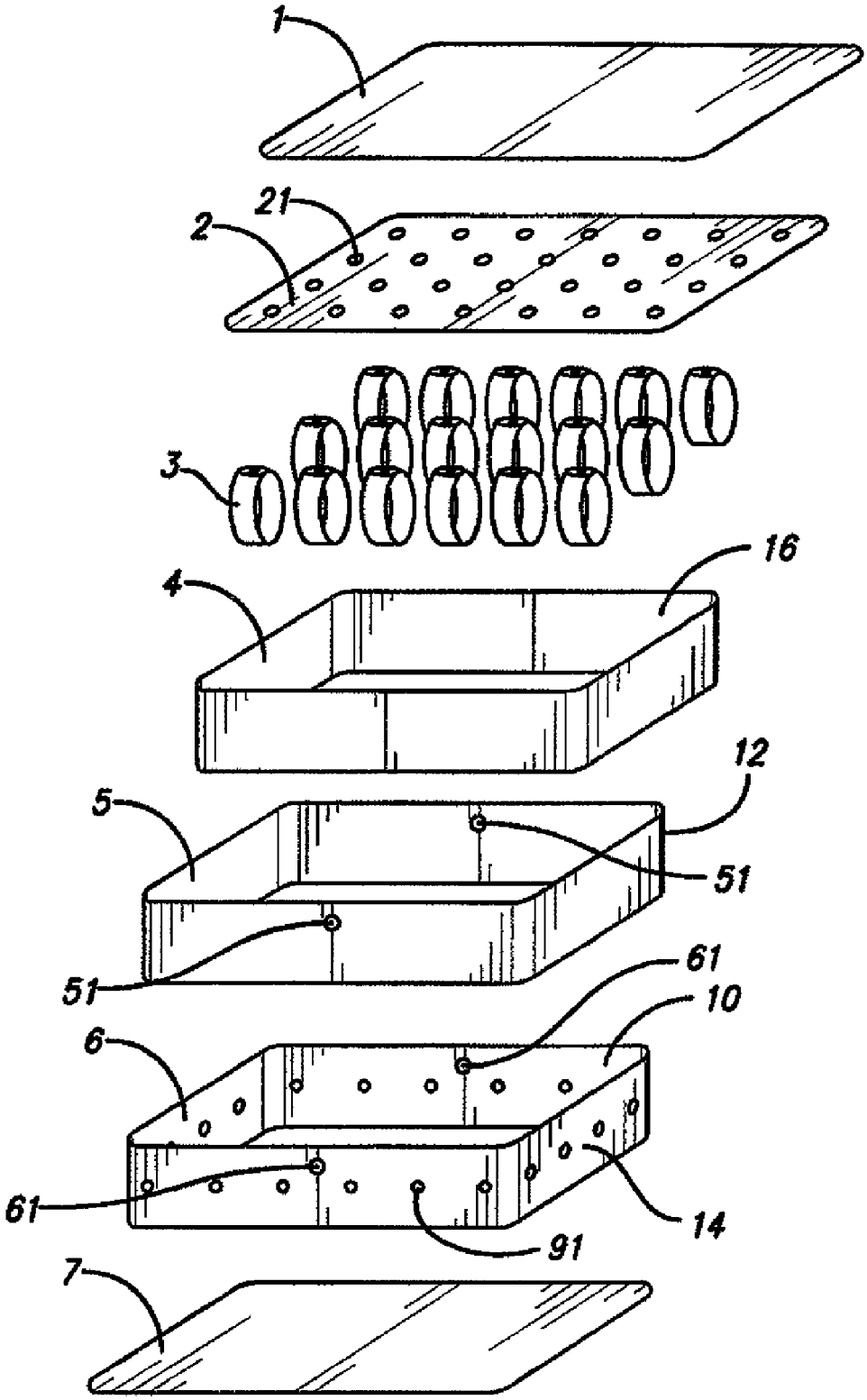
FIG. 3 is an exploded view of a first embodiment the present invention.

Referring now to FIG. 3, there is shown an air-inflated mattress provided by the present invention comprising a top layer 1, a middle layer 2, a plurality of anchor separators 3, an outer shroud band 4, an inner shroud band 5, a middle shroud band 6 and a bottom layer 7. All embodiments will have an inflation input means to inflate the mattress, such as a built-in air pump, a valve to receive an external air source, or other inflation means.

Said anchor separators 3 are generally cylindrical in shape, and connect at their top, to middle layer 2 and at their bottom, to bottom layer 7.

Referring to FIGS. 3, 4, 5, 6, 7 and 8, the inner surface 10 of middle shroud band 6 is partly welded to the outer surface 12 of the inner shroud band 5. The outer surface 14 of middle shroud band 6 is partly welded to the inside surface 16 of outer shroud band 4. The joint portion 18, 18' is arranged alternating to the joint portion 20 of the middle shroud band 6 and the inner shroud band 5. The lower edge of outer shroud band 4 is welded to the rim or edge 22 of bottom layer 7, all around, and the lower edge 24 of inner shroud band 5 is welded to the inside of bottom layer 7, all around. Every anchor separator 3 is put in place, and the separator trunks 25 are welded to the inside 26 of middle layer 2 and to the inner surface 28 of bottom layer 7, respectively.

Figure 7:
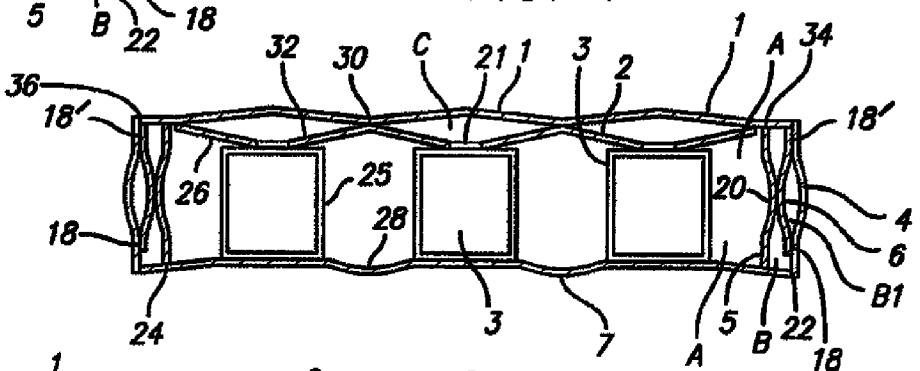
FIG. 7 is a cross-sectional view taken on lines 7-7 of FIG. 4.
Figure 8:
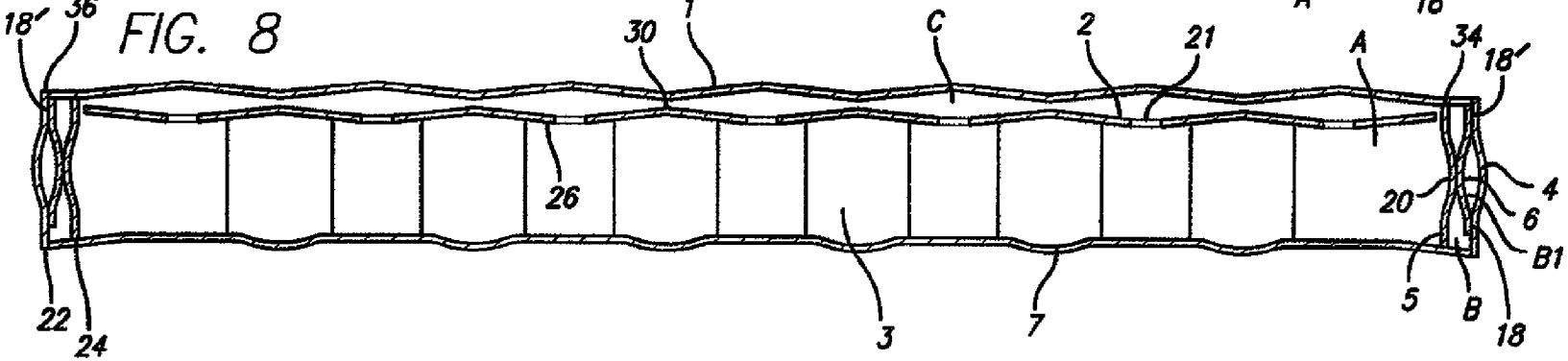
FIG. 8 is a cross-sectional view taken on lines 8-8 of FIG. 4.
Figure 9:
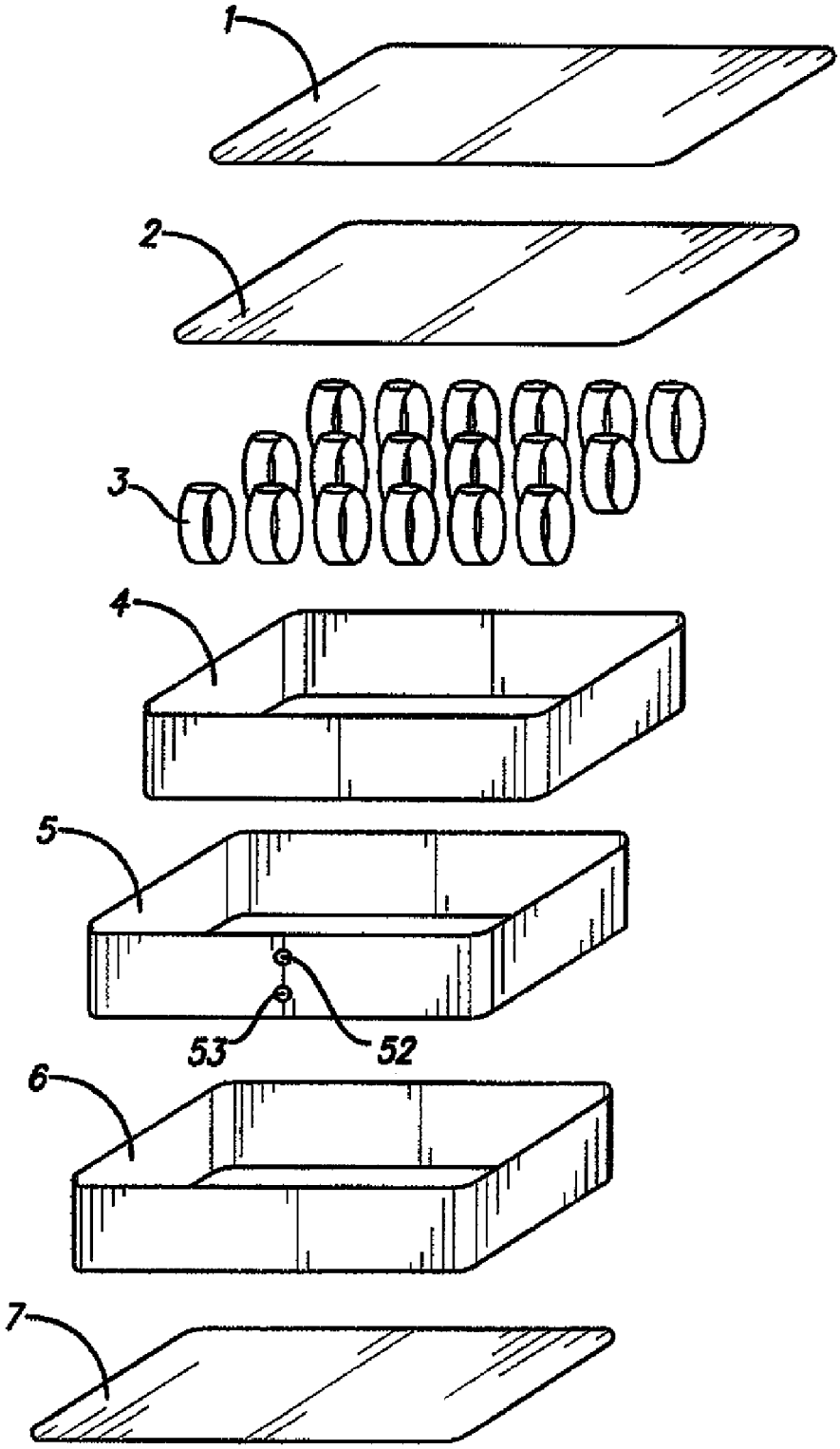
FIG. 9 is an exploded view of a second embodiment of the present invention.
Figure 10:
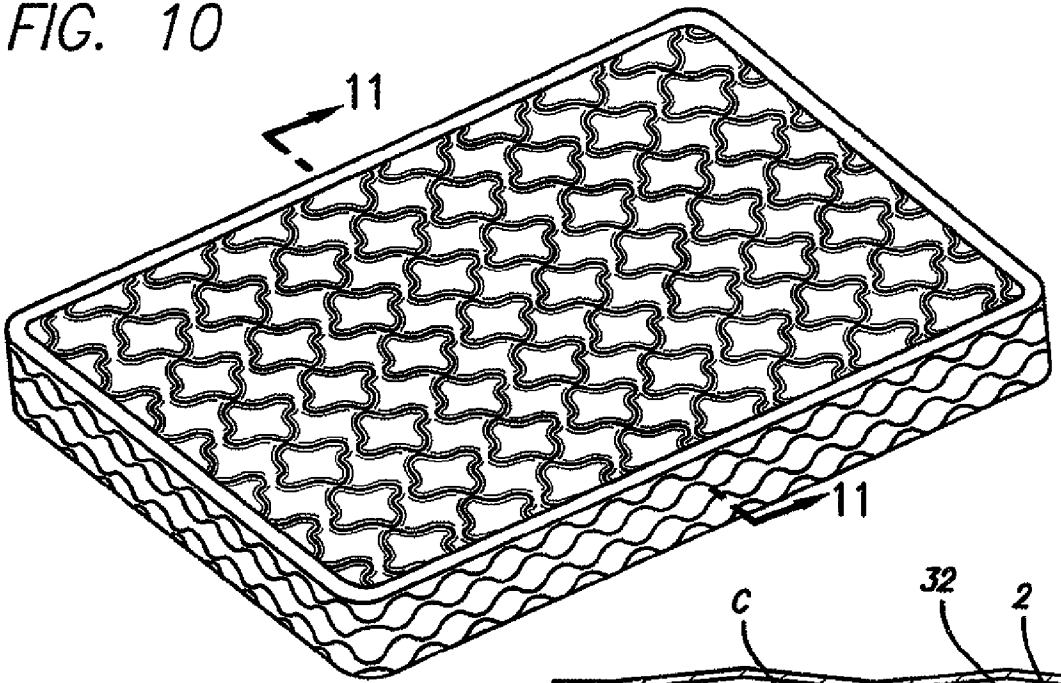
FIG. 10 is a perspective view of the second embodiment.

Middle layer 2 and top layer 1 are welded 30 alternating with the joint portion 32 of middle layer 2 and anchor separators 3 (see FIG. 7). The upper edge 34 of inner shroud band 5 is welded to the inner surface of top layer 1 all around, and finally, the top rim 36 of outer shroud band 4 is welded to the edge of the top layer 1 all around, to finish the whole air mattress. Optionally, an inflating and deflating air pump is built into outer shroud band 4, so that the bladder can be inflated full with air, to form a mattress, (see FIG. 15).

Figure 6:
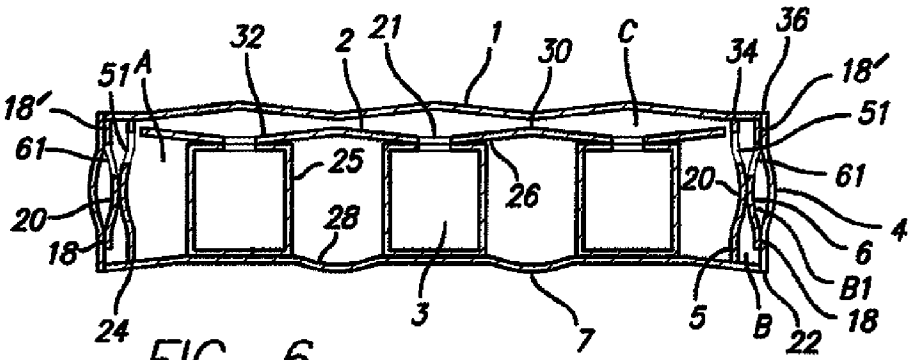
FIG. 6 is a cross-sectional view taken on lines 6-6 of FIG. 4.

Referring specifically to FIG. 6 and FIG. 7, when the air mattress is filled full with air the air enters the space between outer shroud band 4 and inner shroud band 5 filling up side sub-chamber B, then the air passes through inner shroud band 5 entering the space between middle layer 2, bottom layer 7 and inner shroud band 5, to form main bladder A.

Middle shroud band 6 is welded onto inner shroud band 5 at 20 and onto outer shroud band 4 at 18, 18' alternatively and respectively between said side sub-chambers B to work as a reinforcing rib. On the other hand, the joint spot 18, 18' of middle shroud band 6 and outer shroud band 4 is line or point welded, to form a plurality of closed or half-closed circle, rhombus, or other pattern, small side air pockets B1 on shroud band 4 of the air mattress. Air pockets B1 communicate with side sub-chamber B, via riser vents 61 of middle shroud band 6, and via riser vents 91 of middle shroud 6. Side sub-chamber B communicates with main bladder A, via riser vents 51 of inner shroud band 5.

Middle layer 2 is welded 30 to top layer 1 to construct a plurality of closed or half-closed circle or rhombus or other pattern air pockets C, which are arrayed on the top surface of the air mattress which is in contact with the human body. Air pockets C are in communication with main bladder A via overlapped riser vents 21 of middle layer 2.

The present invention has the following advantages:

1. improved evenness and outer look of the surface, due to adding a middle layer 2 below the top layer 1, and fixing anchor separators 3 onto middle layer 2 instead of onto the top layer 1. Also, said top and middle layers 1 and 2 are welded alternatively with said anchor separators 3, so that when bladder A, constructed by the top layer 1 and bottom layer 7 and the outer shroud band 4, is fully inflated with air, the concave points of the middle layer 2, formed by drawing of the anchor separators 3 via the joint portion 32, are covered by convex pockets C of top layer 1, between anchor separators 3 and middle layer 2 joint spots 30 so that they are balanced, the surface of the air mattress is relatively flat and the evenness of the mattress is improved greatly.
2. more comfortable, due to small air pockets C formed between joint spots welding the top layer 1 and the middle layer 2, and the communication of small air pockets C in the inflatable bladder A. When extra force is exerted on parts of the surface of the air mattress, the air in small air pockets C, on the pressed portion of the air mattress, will be baffled by the riser vents of the middle layer 2, escaping slowly without spreading out rapidly, so that the supporting effect of the air mattress, and the air pockets C work as air springs to increase the restoring force, so that the user will feel more comfortable.

3. enhanced edge support, based on the same principle, due to adding a middle shroud band 6 and an inner shroud band 5, inside of outer shroud band 4, to construct half-sealed sub-chambers B. In addition, middle shroud band 6 connects to outer and inner shroud bands 4 and 5 alternatively and respectively to surround sub-chambers B1, so that inflated sub-chambers B1 not only work as reinforcing ribs, but also make outer shroud band 4 flat for improving the outer look of the mattress. When extra force is exerted on the edge of the air mattress, due to the effect of riser vents 61 and 51, the air filled in sub-chambers B1 will not flow rapidly to the inside of bladder A, so the supporting effect of the edge of the air mattress is efficiently improved, without any collapsing or tilting.

Figure 11:
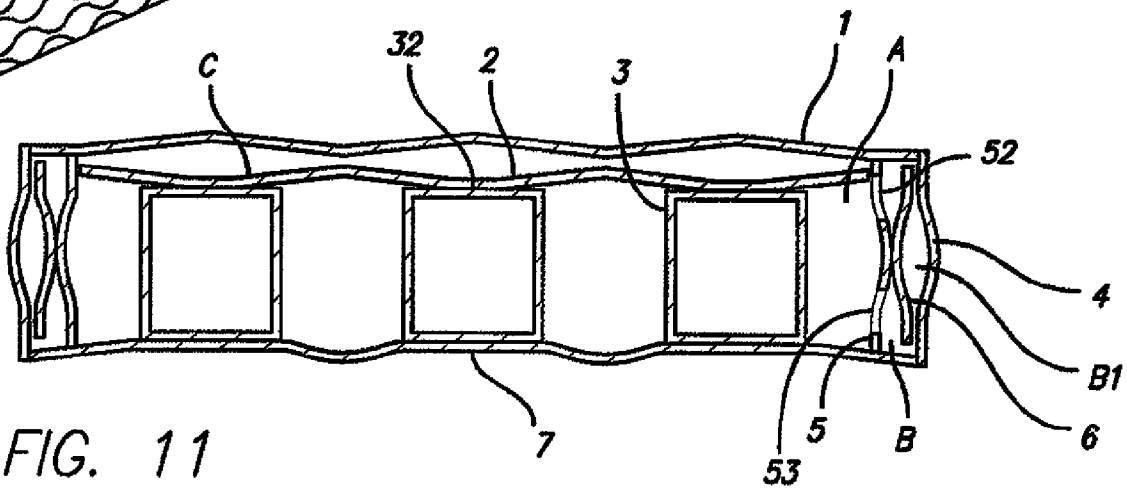
FIG. 11 is a cross-section view taken on lines 11-11 of FIG. 10.
Figure 11A:
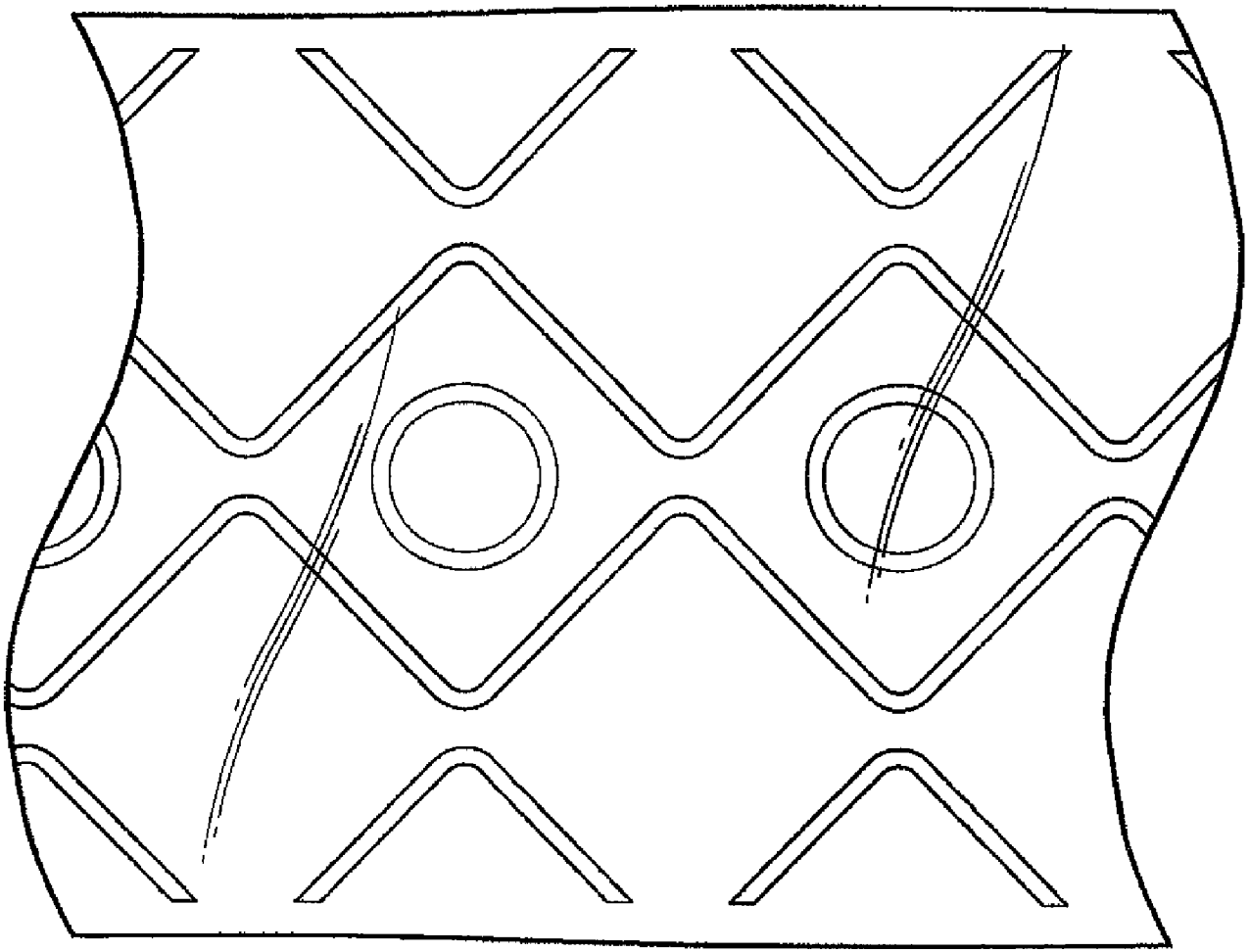
FIG. 11A is a depiction of the outer side of the mattress of the second embodiment.

A second embodiment of the invention is described by reference to FIGS. 9, 10, 11 and 11A. As can be seen, there are no vent holes in the tops of anchor separators 3 and there are no riser vent holes in the sides of middle shroud 6. There are only two vent holes 52 and 53, in one side of inner shroud 5, for air to pass from main bladder A into sub-chamber B. In addition, air passes into the space between top layer 1 and middle layer 2 to fill air pockets C by passing around and over the outer edges of middle layer 2, which edges are not welded to top layer 1. Air enters sub-chambers B-1 by gaps at the air inlet. FIG. 11A shows the pattern of side sub-chambers B1 as seen on the surface of outer shroud 4. In this embodiment, the air moves in and out much more slowly than in embodiment one, making it a stiffer mattress.

Figure 12:
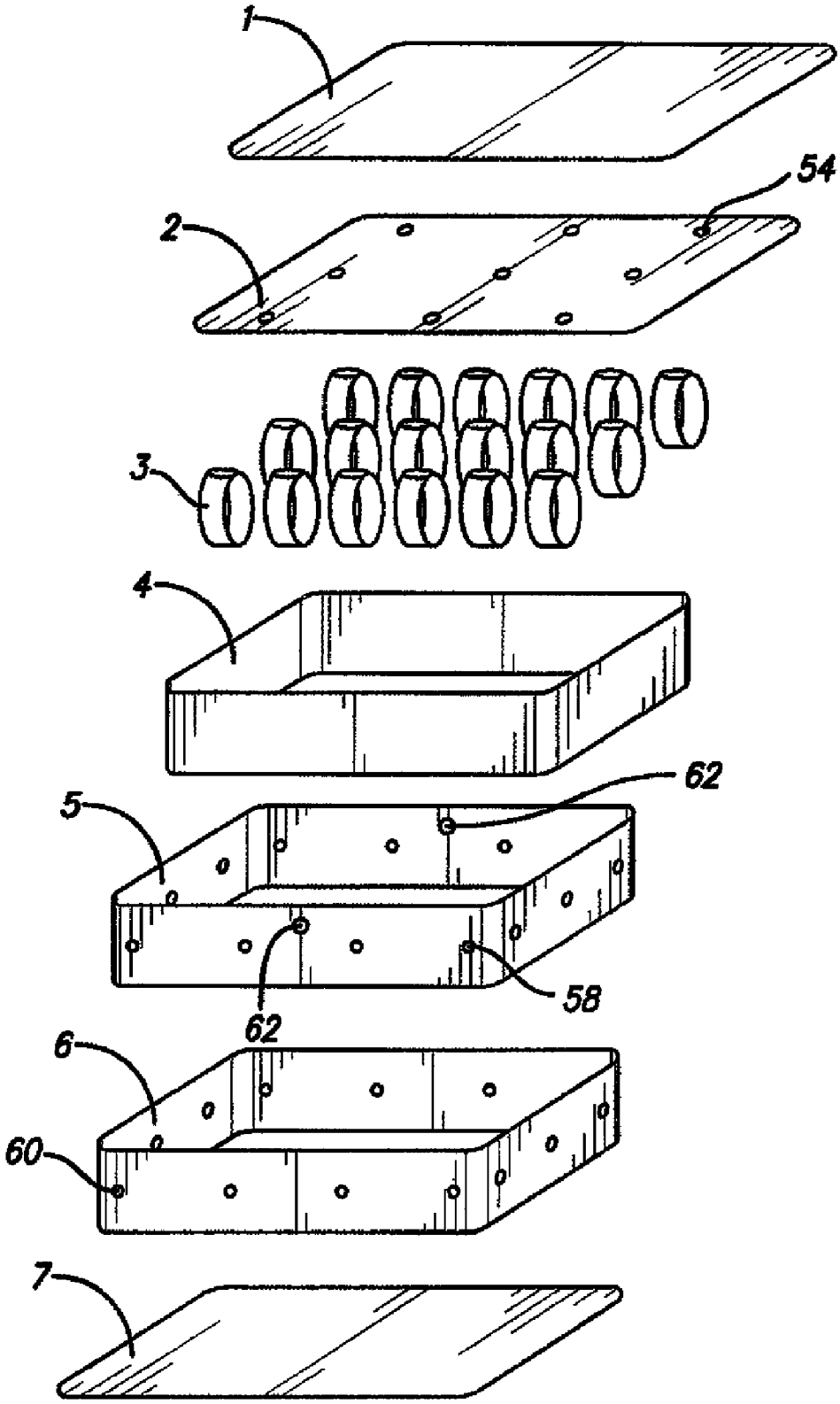
FIG. 12 is an exploded view of a third embodiment of the present invention.
Figure 13:
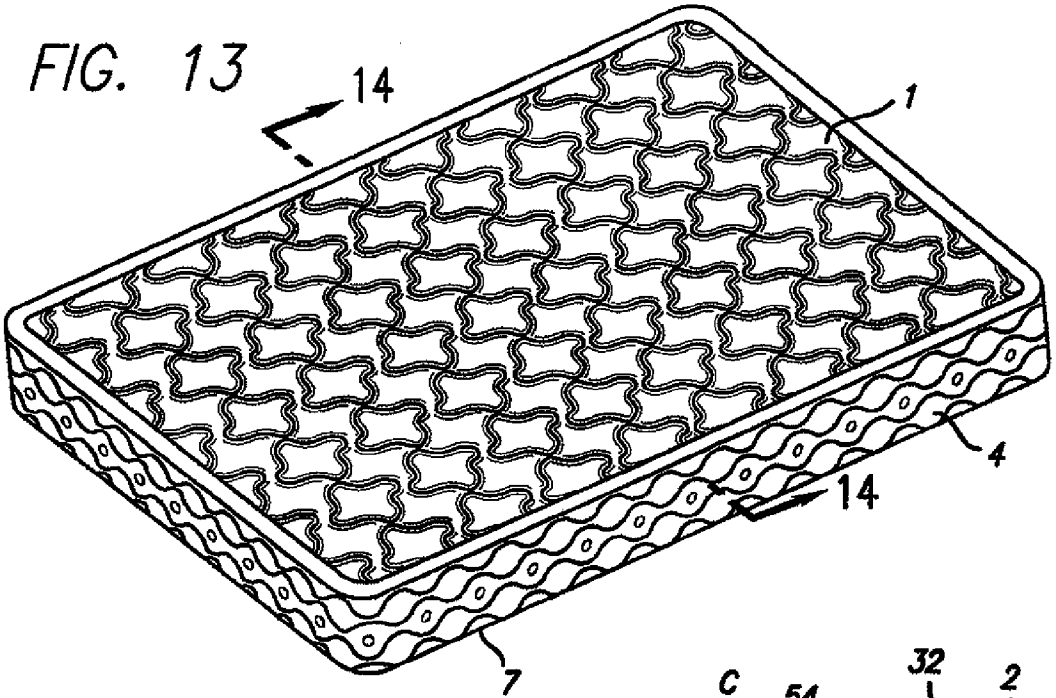
FIG. 13 is a perspective view of the third embodiment.
Figure 14:
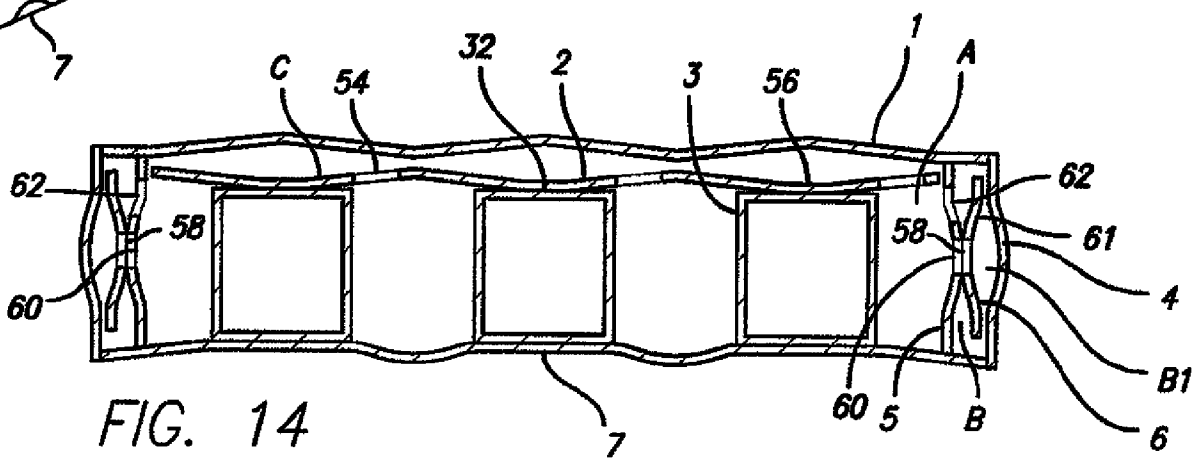
FIG. 14 is a cross-section view taken on lines 14-14 of FIG. 13.

A third embodiment of the invention is described by reference to FIGS. 12, 13 and 14 in which middle layer 2 has a plurality of riser vents 54 adjacent to the joint points 56 of anchor separators 3 to middle layer 2. In addition there are a plurality of riser vent holes 58 and 60 in inner and middle shrouds 5 and 6, but only in alternating side sub-chambers B1 where shrouds 5 and 6 are joined. Riser vents 62 provide airflow between bladder A and subchamber B. This embodiment allows air to flow more quickly than the second embodiment but not as quickly as embodiment one.

Figures 4, 5:
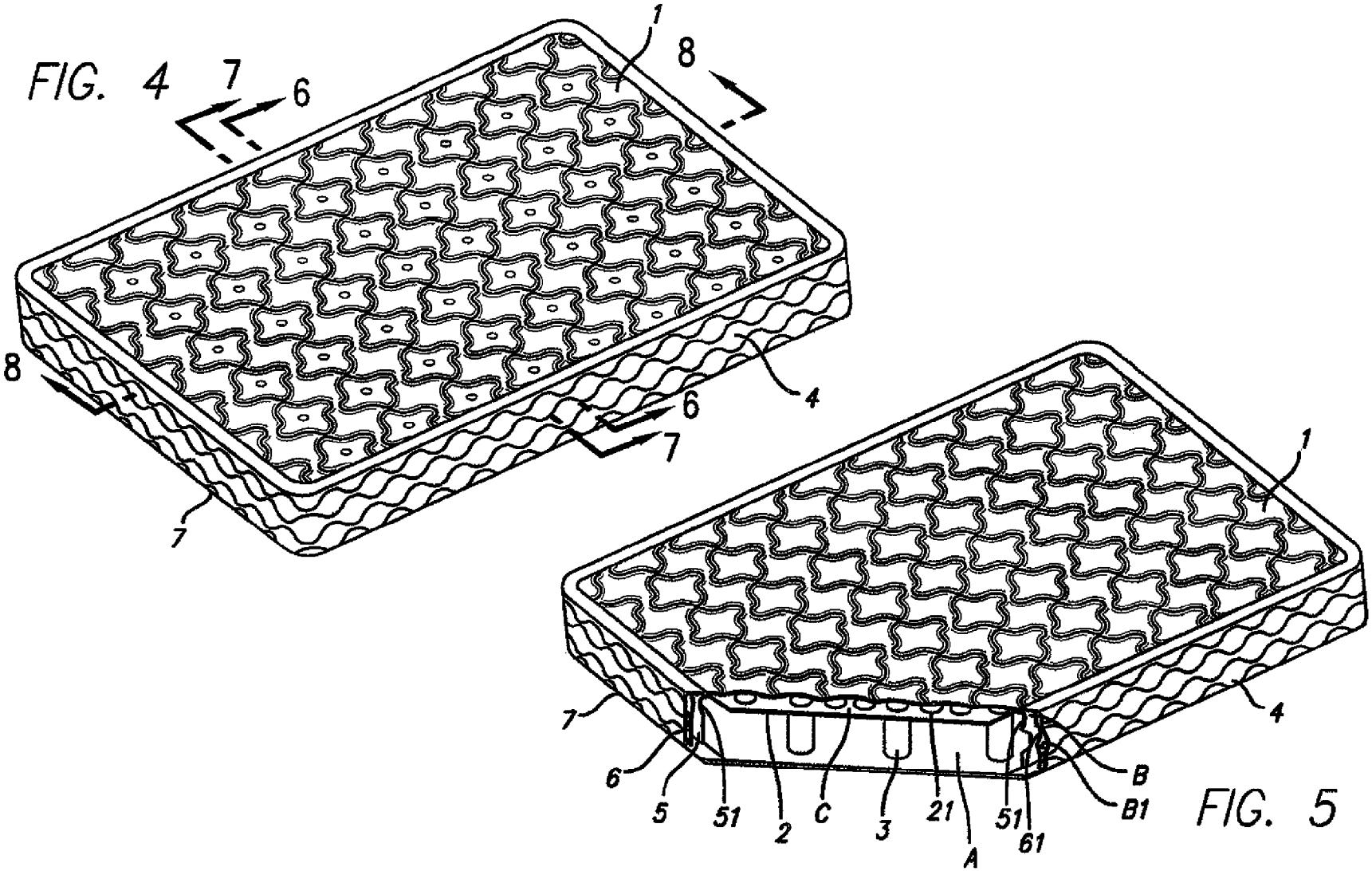
FIG. 4 is a perspective view of the first embodiment.
FIG. 5 is a part-sectional perspective view of the first embodiment.
Figures 15, 16:
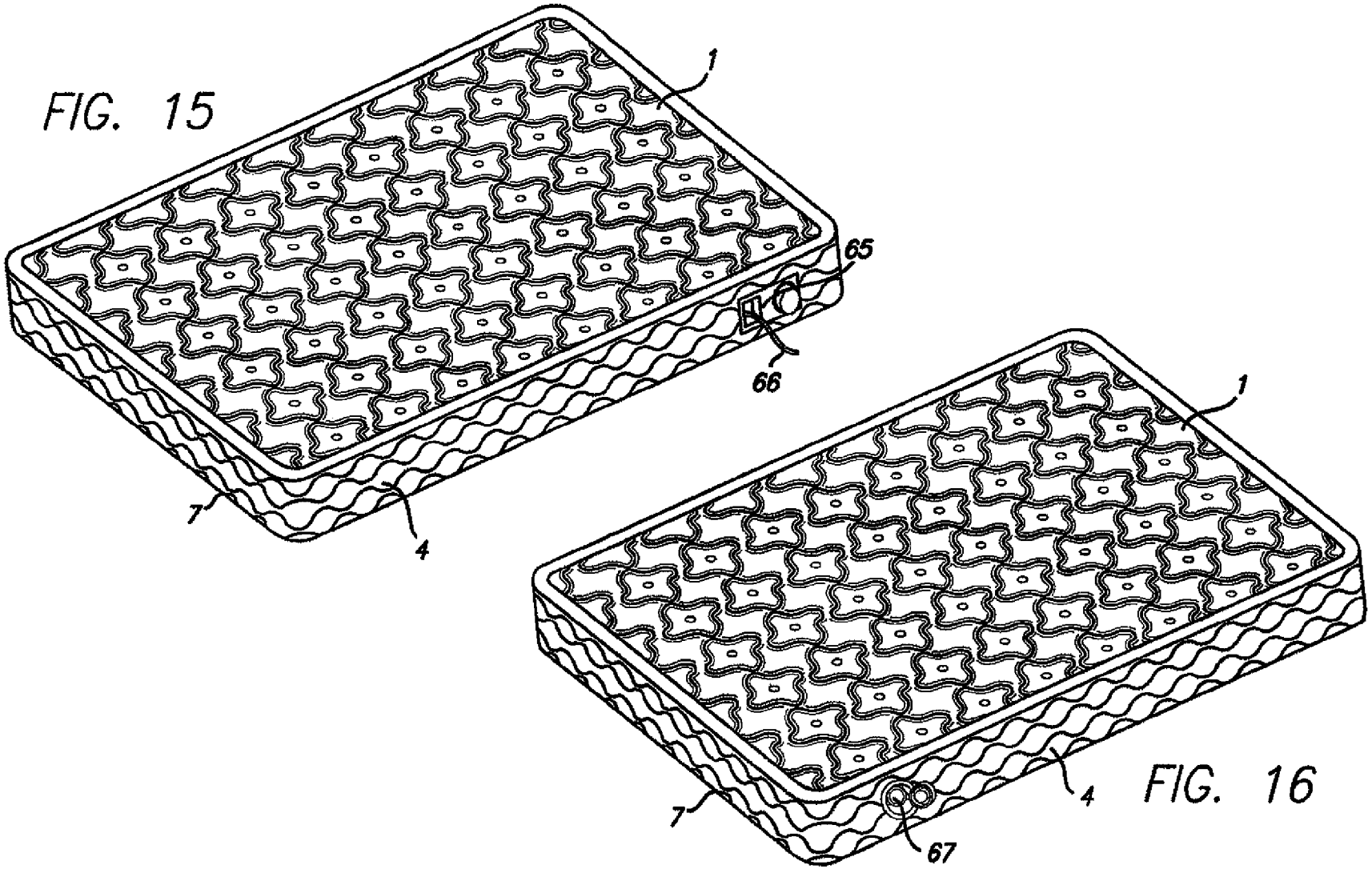
FIG. 15 is a perspective view of the first embodiment showing the inflation mechanism.
FIG. 16 is a perspective view of the first embodiment showing the deflation mechanism.
Figure 17:
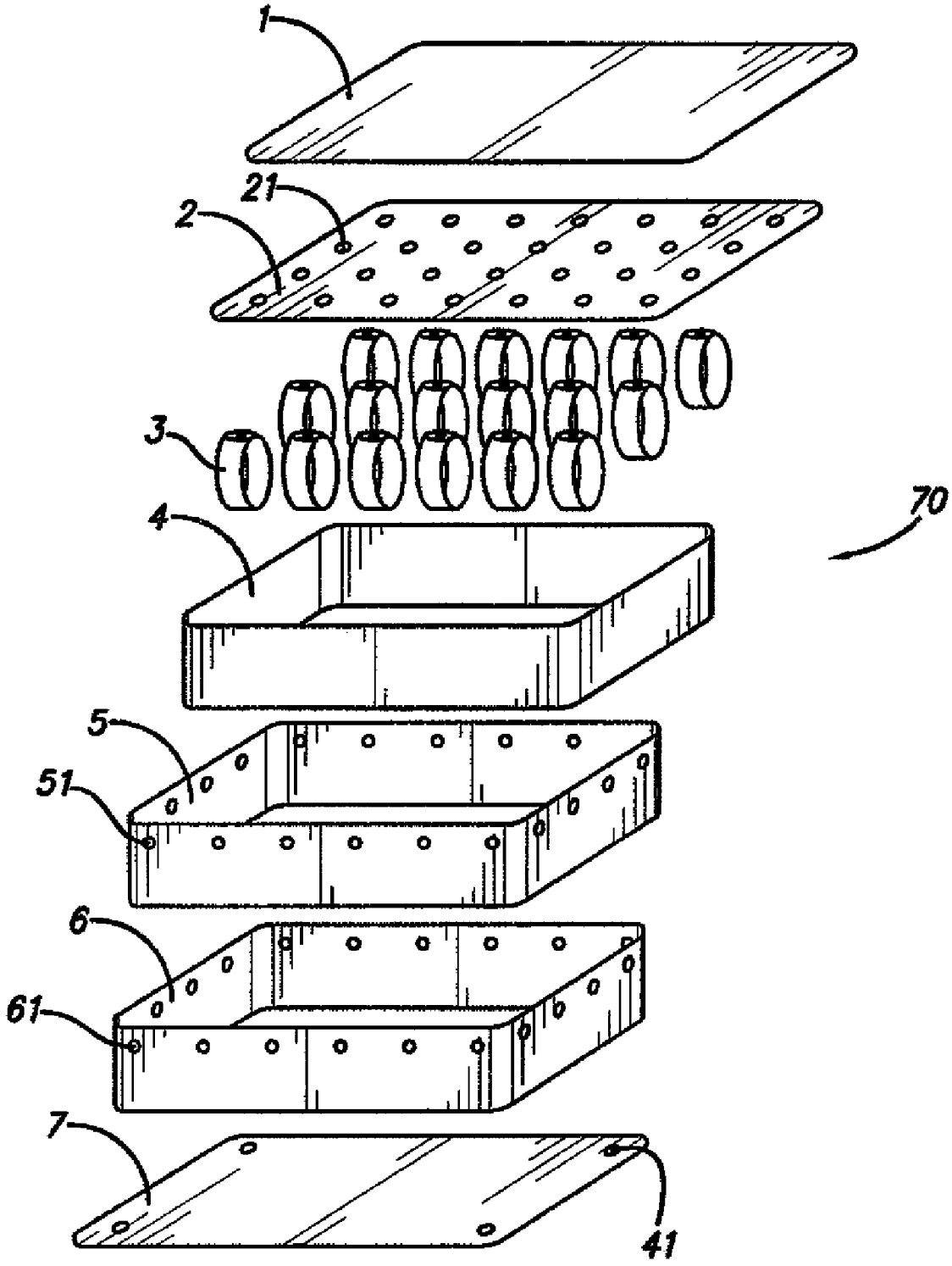
FIG. 17 is an exploded view of the top portion of a fourth embodiment.

FIGS. 15 and 16 show the embodiment of FIG. 4 and show inflation pump 65 set into a housing in the side of shroud 4 of the mattress. Electrical line 66 with a plug (not shown) is connected to pump 65. The other side of the mattress has an optional valve 67 which may be opened to inflate or deflate the mattress.

A fourth embodiment is shown in FIGS. 17 through 21. This embodiment comprises a double mattress, having an upper chamber 70 and a lower chamber 72. Upper chamber 70, shown in FIG. 17, comprises top layer 1, middle layer 2, a plurality of anchor separators 3, an outer shroud 4, an inner shroud 5, a middle shroud 6 and a bottom layer 7. Bottom layer 7 has a plurality of vent holes 41.

Figure 18:
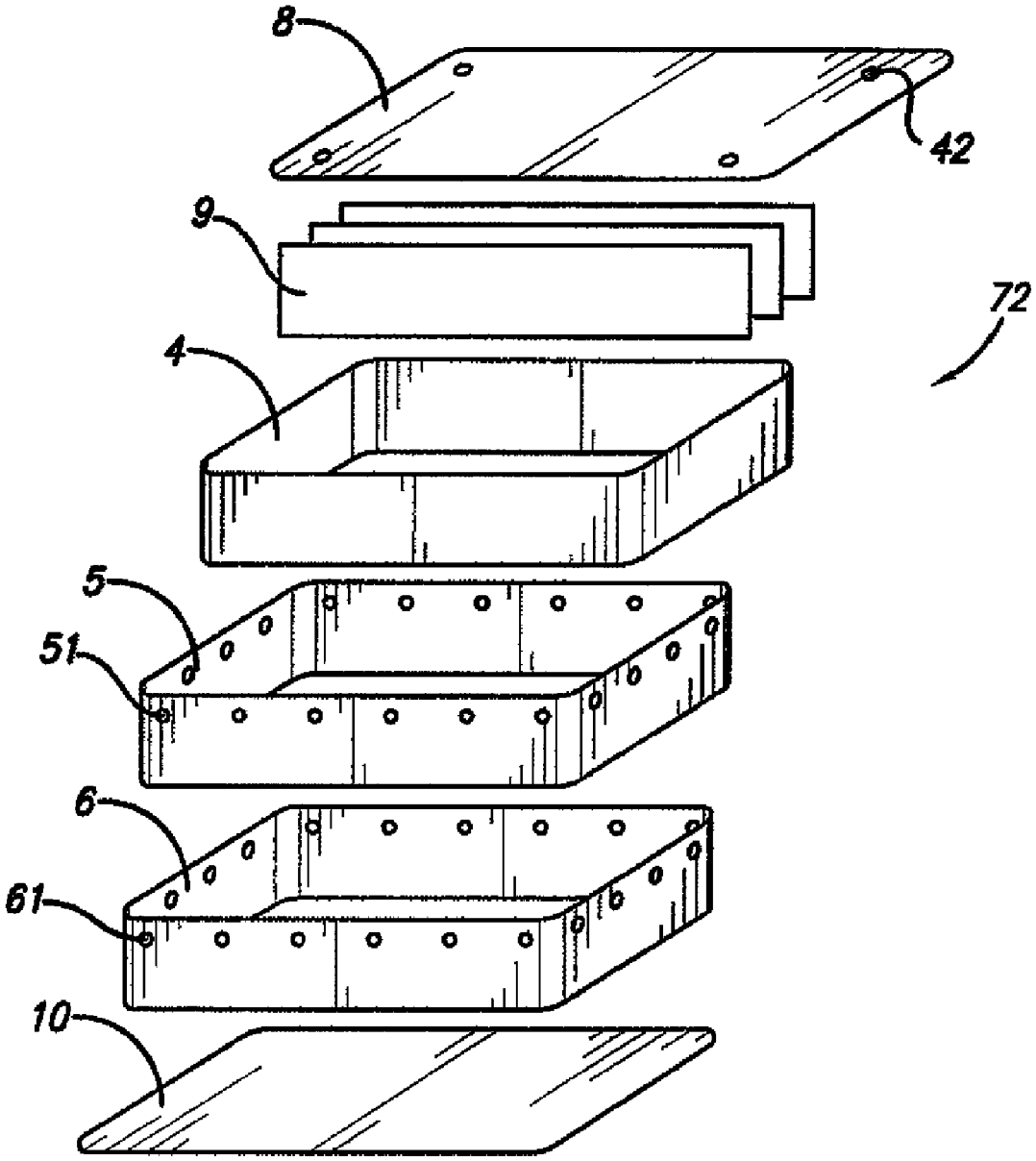
FIG. 18 is an exploded view of the bottom portion of the fourth embodiment.
Figure 19:
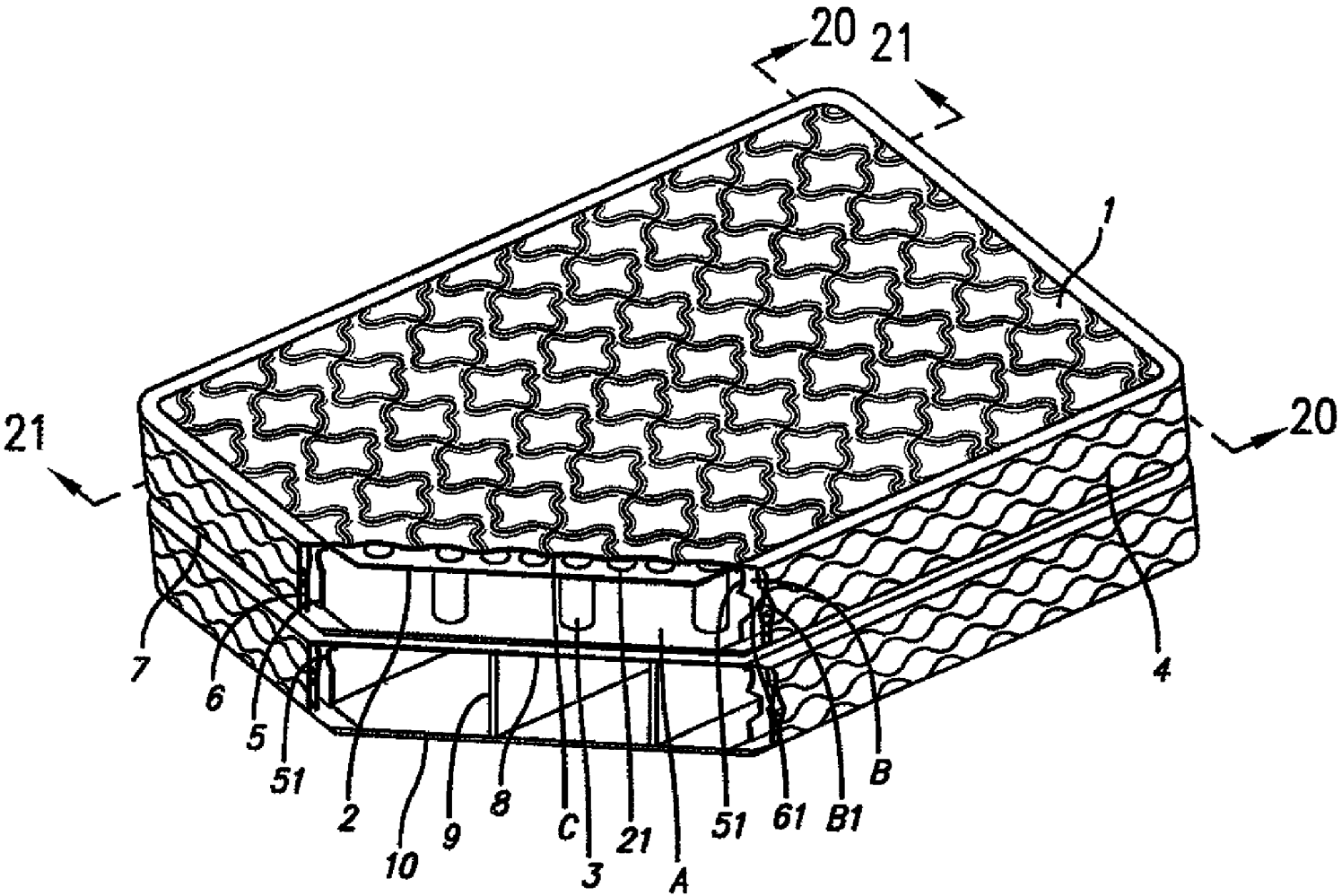
FIG. 19 is a part-sectional perspective view of the fourth embodiment.
Figure 20:
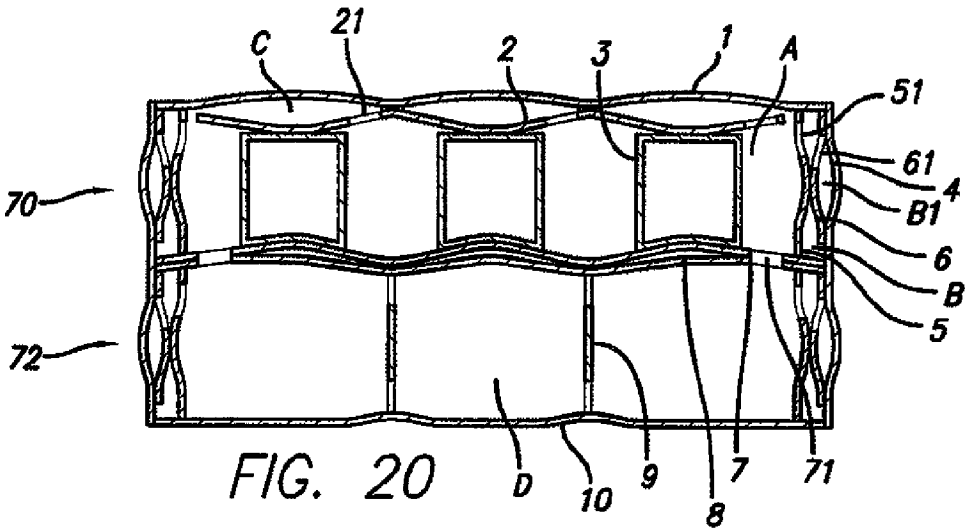
FIG. 20 is a cross-section view taken on lines 20-20 of FIG. 19; and, FIG. 21 is a cross-section view taken on lines 21-21 of FIG. 20.
Figure 21:
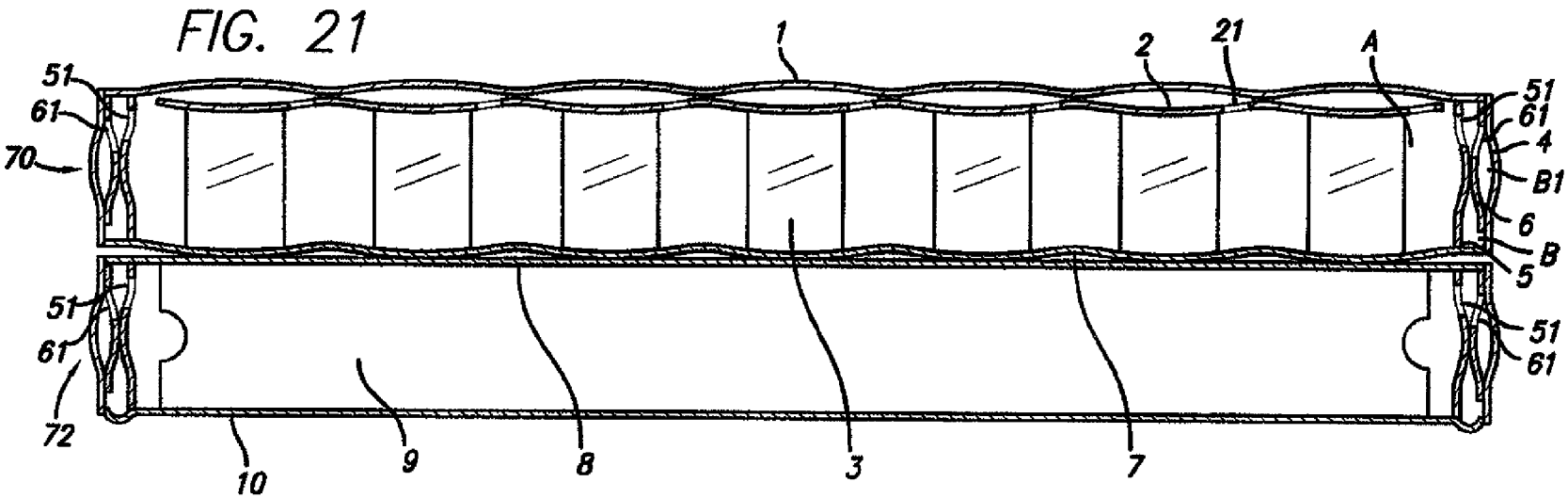

Lower chamber 72, shown in FIG. 18, comprises an upper layer 8, a plurality of I-beam anchor separators 9, an outer shroud 4, an inner shroud 5, a middle shroud 6, and a bottom layer 10. Upper layer 8 has a plurality of vent holes 42 which match up with vent holes 41 in layer 7 of upper chamber 70, so that air may pass between the two chambers, 70 and 72. Layers 7 and 8 are welded together around air vent holes 41 and 42.

Air passes through vent holes 51 and 61 into sub-chambers B and B1 and into bladder A and through riser vents 21 into small air pockets C. This embodiment provides a high-rise mattress with superior support provided by lower chamber 72 having I-beam anchor separators 9 for added support. I-beam anchor separators 9 are welded to the top of layer 10 and to the bottom of layer 8 and are placed below and in between anchor separators 3, to keep the lower bladder D level and even. The double mattress is easier to sit on, or lie down on, because of its greater height from the floor and it also raises the user farther from a cold floor.

While I-beams are used as anchor separators in the lower chamber, as shown in this embodiment, any other types of anchor separators, as described previously hereinabove, may be utilized.

Variations of the placement and the number of riser vents or holes between the chambers described may be made at the desire of the manufacturer, which will change the stiffness and feel of the mattress. However, the use of additional shrouds and the additional layer in the construction as described, provides an air mattress which is firmer, more comfortable for the user and more like an innerspring mattress.

While the air-inflated mattress of the present invention has been described with reference to certain embodiments, the invention is not limited to the particular embodiments disclosed. Other variations, in design may occur to those skilled in the art without departing from the scope of the invention. The scope of the invention is limited only by the claims appended hereto.

We claim:

1. A double air-inflated mattress comprising an upper chamber and a lower chamber, said upper chamber comprising a top layer, an outer shroud band, a plurality of anchor separators spaced apart from each other and a bottom layer, said outer shroud band connecting the top and bottom layers to form an inflatable bladder, a middle layer below said top layer partially sealed to the top layer to form a plurality of sealed or half-sealed cavities, in which some or all of said cavities are in fluid communication with the inflatable bladder, said lower chamber comprising a top layer, an outer shroud band, a plurality of anchor separators and a bottom layer, said outer shroud band connecting the top and bottom layers to form an inflatable bladder, in which the upper chamber anchor separators are welded at the top to the middle layer and at the bottom to the bottom layer and the middle layer has a plurality of air vent holes which communicate with the inflatable bladder.

2. The double air-inflated mattress of claim 1 wherein the anchor separators in the lower chamber are I-beams.

3. The double air-inflated mattress of claim 1 in which bottom layer of the upper chamber has a plurality of vent holes, the top layer of the lower chamber has a plurality of vent holes, in which the vent holes of the bottom layer of the upper chamber and the vent holes of the top layer of the lower chamber are concentric.

4. The double air-inflated mattress of claim 1 in which the bottom layer of the upper chamber and the top layer of the lower chamber are welded together.

5. The double air-inflated mattress of claim 3 in which the bottom layer of the upper chamber and the top layer of the lower chamber are welded together around said vent holes.

6. The air inflated mattress of claim 1, further comprising a built-in inflation or inflation/deflation pump.

7. A double air-inflated mattress comprising an upper chamber and a lower chamber, said upper chamber comprising a top layer, an outer shroud band, a plurality of anchor separators and a bottom layer, said outer shroud band connecting the top and bottom layers to form an inflatable bladder, a middle layer below said top layer partially sealed to the top layer to form a plurality of sealed or half-sealed cavities, in which some or all of said cavities are in fluid communication with the inflatable bladder, said lower chamber comprising a top layer, an outer shroud band, a plurality of anchor separators and a bottom layer, said outer shroud band connecting the top and bottom layers to form an inflatable bladder in which said upper chamber further comprises a middle shroud band and an inner shroud band, and said lower chamber further comprises a middle shroud band and an inner shroud band, wherein both of said middle shroud bands are separately welded to the outer shroud band and the inner shroud band to form a plurality of closed or half-closed cavities, some or all of said cavities being in fluid communication with said inflatable bladder to form a plurality of air pockets on the outer shroud bands of the air mattress.

8. The double air-inflated mattress of claim 7, wherein each of said middle and inner shroud bands have riser vents which communicate with the inflatable bladder in their respective chambers.

9. A double air-inflated mattress comprising an upper chamber and a lower chamber, said upper chamber comprising a top layer, an outer shroud band, a plurality of anchor separators and a bottom layer, said outer shroud band connecting the top and bottom layers to form an inflatable bladder, a middle layer below said top layer partially sealed to the top layer to form a plurality of sealed or half-sealed cavities, in which some or all of said cavities are in fluid communication with the inflatable bladder, said lower chamber comprising a top layer, an outer shroud band, a plurality of anchor separators and a bottom layer, said outer shroud band connecting the top and bottom layers to form an inflatable bladder, in which the upper chamber anchor separators are generally cylindrical in shape, are welded at the top to the middle layer and at the bottom to the bottom layer and have an air vent hole through the top weld with the middle layer.

10. A double air-inflated mattress comprising an upper chamber and a lower chamber, said upper chamber comprising a top layer, an outer shroud band, a plurality of anchor separators and a bottom layer, said outer shroud band connecting the top and bottom layers to form an inflatable bladder, a middle layer below said top layer partially sealed to the top layer to form a plurality of sealed or half-sealed cavities, in which some or all of said cavities are in fluid communication with the inflatable bladder, forming a plurality of air-pockets on the top surface of the mattress, said lower chamber comprising a top layer, an outer shroud band, a plurality of anchor separators and a bottom layer, said outer shroud band connecting the top and bottom layers to form an inflatable bladder; the upper chamber and the lower chamber both further comprising a middle shroud band and an inner shroud band, wherein each of said middle shroud bands is separately welded to the outer shroud band and the inner shroud band to form a plurality of closed or half-closed cavities, some or all of said cavities being in fluid communication with its respective inflatable bladder to form a plurality of air pockets on the outer shroud band of the air mattress.

11. The double mattress of claim 10 wherein the anchor separators in the lower chamber are I-beams.

12. The double mattress of claim 10 in which the bottom layer of the upper chamber and the top layer of the lower chamber are welded together.

13. The double air-inflated mattress of claim 10 in which bottom layer of the upper chamber has a plurality of vent holes, the top layer of the lower chamber has a plurality of vent holes, in which the vent holes of the bottom layer of the upper chamber and the vent holes of the top layer of the lower chamber are concentric.

14. The double air-inflated mattress of claim 13 in which the bottom layer of the upper chamber and the top layer of the lower chamber are welded together around said vent holes.

15. The double air-inflated mattress of claim 10, wherein each of said middle and inner shroud bands have riser vents which communicate with the inflatable bladder in their respective chambers.

16. The double air-inflated mattress of claim 10 in which the upper chamber anchor separators are generally cylindrical in shape, are welded at the top to the middle layer and at the bottom to the bottom layer and have an air vent hole through the top weld with the middle layer.

17. The air inflated mattress of claim 10, further comprising a built-in inflation or inflation/deflation pump.

18. A double air-inflated mattress comprising an upper chamber and a lower chamber, said upper chamber comprising a top layer, an outer shroud band, a plurality of anchor separators and a bottom layer, said outer shroud band connecting the top and bottom layers to form an inflatable bladder, a middle layer below said top layer partially sealed to the top layer to form a plurality of sealed or half-sealed cavities, in which some or all of said cavities are in fluid communication with the inflatable bladder, said lower chamber comprising a top layer, an outer shroud band, a plurality of anchor separators and a bottom layer, said outer shroud band connecting the top and bottom layers to form an inflatable bladder in which said upper chamber further comprises a middle shroud band and an inner shroud band, and said lower chamber further comprises a middle shroud band and an inner shroud band, wherein both of said middle shroud bands are separately welded to the outer shroud band and the inner shroud band.

19. The double air-inflated mattress of claim 18, wherein each of said middle and inner shroud bands have riser vents which communicate with the inflatable bladder in their respective chambers.

* * * * *